US008022914B2

(12) United States Patent
Lienhard

(10) Patent No.: US 8,022,914 B2
(45) Date of Patent: Sep. 20, 2011

(54) DISPLAY DEVICE AND METHOD FOR DRIVING A DISPLAY DEVICE WITH REDUCED POWER CONSUMPTION

(75) Inventor: Martin Lienhard, Oberentfelden (CH)

(73) Assignee: NXP B.V., Eindhoven (NL)

( * ) Notice: Subject to any disclaimer, the term of this patent is extended or adjusted under 35 U.S.C. 154(b) by 1266 days.

(21) Appl. No.: 10/559,916

(22) PCT Filed: Jun. 2, 2004

(86) PCT No.: PCT/IB2004/050826

§ 371 (c)(1),
(2), (4) Date: Dec. 7, 2005

(87) PCT Pub. No.: WO2004/111988

PCT Pub. Date: Dec. 23, 2004

(65) Prior Publication Data

US 2006/0132412 A1 Jun. 22, 2006

(30) Foreign Application Priority Data

Jun. 12, 2003 (EP) ..... 03101709

(51) Int. Cl.
*G09G 3/36* (2006.01)

(52) U.S. Cl. ..... 345/94; 345/100; 345/87

(58) Field of Classification Search ..... 345/204, 345/208, 209, 690, 87–102
See application file for complete search history.

(56) References Cited

U.S. PATENT DOCUMENTS

| | | | |
|---|---|---|---|
| 6,407,727 | B1 | 6/2002 | Plangger |
| 6,538,629 | B1 | 3/2003 | Ito |

FOREIGN PATENT DOCUMENTS

| | | | |
|---|---|---|---|
| EP | 1 341 150 | | 9/2003 |
| JP | 8-248928 | A | 9/1996 |
| JP | 2003-57623 | A | 2/2003 |
| JP | 2003-157062 | A | 5/2003 |

*Primary Examiner* — Nitin Patel

(57) ABSTRACT

The invention concern a display device comprising a liquid crystal material between a first substrate provided with row electrodes (7) and a second substrate provided with column electrodes (6), in which overlapping parts of the row and column electrodes define pixels (8), driving means (5) for driving the column electrodes (6) in conformity with an image to be displayed, and driving means (4) for driving the row electrodes (7), wherein the row electrodes (7) select at least one row during a row selection time and column voltages ($G_j(t)$) are supplied to the column electrodes (6), wherein the column voltage waveform depends on the grey scale to be displayed by the driven pixel in a certain column and depends on a used selection signal ($F_i$) for the selected row, wherein a column voltage ($G_j(t)$) is switchable between at least two different column voltage levels during a row selection time. To provide a display device having low power consumption and in particular to minimize the number of transitions of the column driving signal the column voltage waveform for a following row selection time is mirrored on a mirror axis, if the column voltage at the end of the current row selection time is the same as the column voltage at the end of the following row selection time.

18 Claims, 6 Drawing Sheets

DISPLAY DEVICE AND METHOD FOR DRIVING A DISPLAY DEVICE WITH REDUCED POWER CONSUMPTION

The present invention concerns generally passive matrix displays, in particular to a display device and a method for driving a display device, wherein the display device comprises a liquid crystal material between a first substrate provided with row electrodes and a second substrate provided with column electrodes, in which overlapping parts of the row and column electrodes define pixels, driving means for driving the column electrodes in conformity with an image to be displayed, and driving means for driving the row electrodes.

The display technique will play an increasingly important role in the information and communication technique in the years to come. Being an interface between humans and the digital world, the display device is of crucial importance for the acceptance of contemporary information systems. Notably portable apparatus such as, for example, notebooks, telephones, digital cameras and personal digital assistants cannot be realized without utilizing displays. The passive matrix LCD technology is a very commonly used display technology; it is used, for example in PDA's and in mobile telephones. Passive matrix displays are usually based on the (S)TN (Super Twisted Nematic) effect. A passive matrix LCD consists of a number of substrates. The display is subdivided in the form of a matrix of rows and columns. The row electrodes and column electrodes are arranged on respective substrates and form a grid. A layer with liquid crystals is provided between said substrates. The intersections of these electrodes form pixels. These electrodes are supplied with voltages that orient the liquid crystal molecules of the driven pixels in an appropriate direction so that the driven pixel appears in a different brightness.

Since the size of the displays becomes larger, the significance of the power consumption of the passive matrix LCDs for mobile applications increases all the time. Because such passive matrix displays are often used in portable apparatus, it is particularly important to realize low power consumption.

In general the row electrodes of passive matrix display devices are selected or activated by a row selection voltage for a row selection time, whereas the image data to be displayed is supplied via the column electrodes. There are different schemes for driving display devices. The most common driving scheme is the so called Alt & Pleshko driving scheme. Here each row will be selected separately. At the time the respective row is selected the required column voltages are supplied to the column electrodes. So each pixel in the selected row will show its respective grey scale. After a row has been selected, the next row will be selected until all rows of the display are selected one time. Thereby, a so-called frame is defined as the time it takes to select all rows of the display—in the case of Alt & Pleshko driving—exactly once.

Another more recent driving scheme is the so called multiple row addressing scheme (MRA). Here a group of p rows is simultaneously driven and the encoded image information is applied to the columns. This MRA technique enables a very good optical performance to be achieved in combination with low power consumption. According to said MRA technique a number of p rows are simultaneously driven. A set of orthogonal functions is then applied to the p simultaneously driven rows. A function for the column voltage for driving the corresponding column is calculated from said set of orthogonal functions using a calculation rule. By using this calculation rule for driving the column, a voltage is selected from a plurality of partial column voltage values, said selected voltage being applied to the corresponding column so that the corresponding pixels are switched to a state depending on the image data that is supplied from a memory.

In order to display grey scales a method called Pulse Width Modulation (PWM) can be used. This method that is combined either with Alt & Pleshko driving or MRA driving is based on the splitting of one row selection time into several row sub selection time slots. By variation of the column voltage level between subsequent row sub selection time slots within a certain row selection time, the corresponding pixel can be driven to a grey scale. When splitting one single row selection time in $n_{pwm}$ sub selection time slots $n_{pwm}+1$ different grey scales can be generated.

A characteristic of this grey scale method is that for each row sub selection time slot the column voltage to be driven has to be calculated. This requires foremost in combination with MRA driving an intensive data processing. Moreover, the column voltage may change its level at most once with each new row sub selection time slot, whereby introducing many transitions into the column voltage waveform. Both, an intensive data processing as well as a high number of transitions have a negative impact on the overall power consumption of the driver.

Therefore it is an object of the invention to provide a display device, a circuit arrangement for driving such display device and a method for driving a display device having low power consumption. In particular it is an object to minimize the number of transitions of the column driving signal.

This object is solved by the subjects of the independent claims.

To this end a display device according to the present invention is provided comprising a liquid crystal material between a first substrate provided with row electrodes and a second substrate provided with column electrodes, driving means for driving the column electrodes in conformity with an image to be displayed, and driving means for driving the row electrodes, wherein during a row selection time at least one row is selected and column voltages ($G_j(t)$) are supplied to the column electrodes, wherein the column voltage waveform depends on the grey scale to be displayed by a driven pixel in a certain column and depends on a used selection signal ($F_i$) supplied to the selected row, wherein a column voltage ($G_j(t)$) is switchable between at least two different column voltage levels during the row selection time and the column voltage waveform for a following row selection time is mirrored on a mirror axis depending on the column voltage at the end of the current row selection time and the column voltage at the end of the following row selection time.

In a preferred embodiment of the invention the mirroring is performed, if the column voltage at the end of the current row selection time is the same as the column voltage at the end of the following row selection time.

In a preferred embodiment of an inventive display device the mirroring is performed by mirroring the column voltage waveform for every second row selection time. It is also possible to use a different distance between the row selection times. This kind of fix mirroring is very simple to realize.

In an alternative preferred embodiment of an inventive display device the mirroring is performed adaptively. In that embodiment it is not possible to say, which row selection time will be mirrored, because the mirroring is only performed if a transition can be saved. This requires a calculation whether a transition can be saved. By calculating the following column voltage level for the subsequent row selection time or in particularly by calculating the column voltage level of the last row sub slot of the subsequent row selection time already during the current row selection time, then the possibility exists to reduce the number of transitions by mirroring the column waveform of the following row selection time whenever this is of advantage—so-called adaptive mirroring. This reduced number of transition in the column voltage waveform has a positive impact on the power consumption of the driver.

This adaptive column mirroring can be applied to various driving schemes including Alt & Pleshko and MRA as long as they are combined with Pulse Width Modulation. The most important advantage of adaptive column voltage mirroring is that therewith up to 50% of the column transitions can be saved but under no circumstances the number of transitions is increased. Since the number of transitions has a direct impact on the power consumption—the less transitions the lower the power consumption—the presented display device can considerably reduce the power consumption of the driver.

In a further alternative embodiment the mirroring is activated if $V_{col}(t=n\ T_r-dt)=V_{col}\ (t=(n+1)T_r-dt)$ is true for n=1, 2, 3 for the n subsequent row selection times, wherein $T_r$ represents the row selection time and dt one incremental time step.

In a further alternative embodiment the mirroring is performed within a window, whereas the size of the windows to be mirrored has to be at least three row sub selection time slots. By doing this, the mirroring can be performed in a very effective way resulting in a column voltage signal having a significant lower number of transitions. The mirroring within a window, e.g. the window includes three sub selection row slots, is only performed whenever the voltage level of the third row sub slot is the same as the one in the first row sub slot, if so—the second and the third row sub slot will be exchange—hence mirrored on the mirror axis between the second and third row sub slot.

In a further preferred embodiment the position of the mirror axis depends on the number of row sub selection time slots comprised in the window. There is a further advantage to calculate the column voltage level of the over-next row sub selection time slot during the current row sub selection time slot.

In a particular preferred embodiment the mirroring is activated if $V_{col}(t=m\ T_{rs}-dt)=V_{col}(t=(m+2)\ T_{rs}-dt)$ for m=1, 2, 3, . . . , M but not for m=M−1, wherein $M=T_r/T_{rs}$ is the number of row sub selection time slots per row selection time slot and, with $T_{rs}$ being the row sub selection time and dt being one incremental time step, wherein m is reset to 1 after having reached M.

The object of the present invention is further solved by a circuit arrangement for driving a display device as claimed in claim 9.

The object of the present invention is further solved by a method for driving a display device as claimed in claim 10.

For a more complete description of the present invention and for further objects and advantages thereof, reference is made to the following description, taken in conjunction with the accompanying drawings, in which.

Figure 4A:
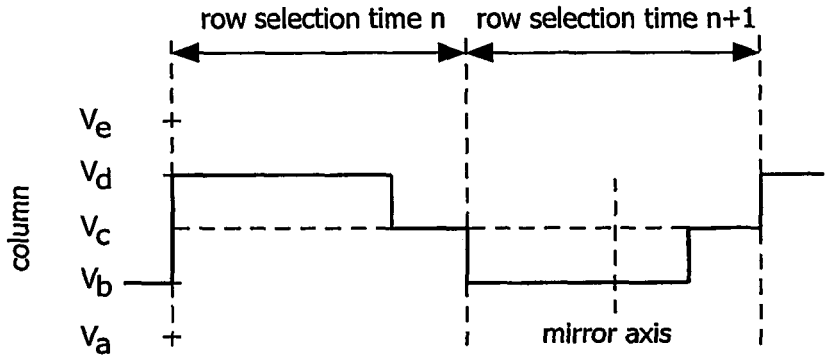
Figure 4B:
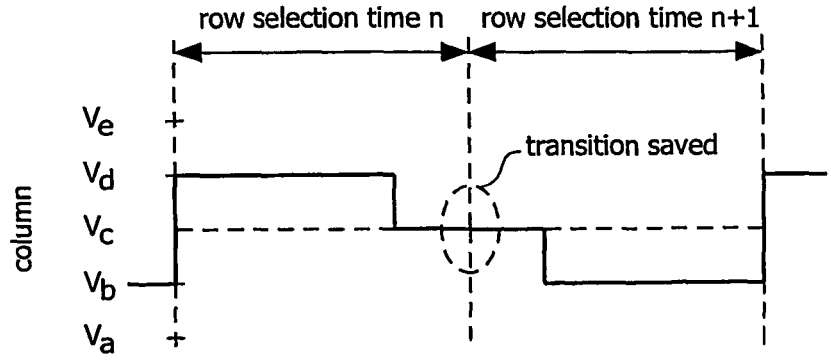
Figure 5A:
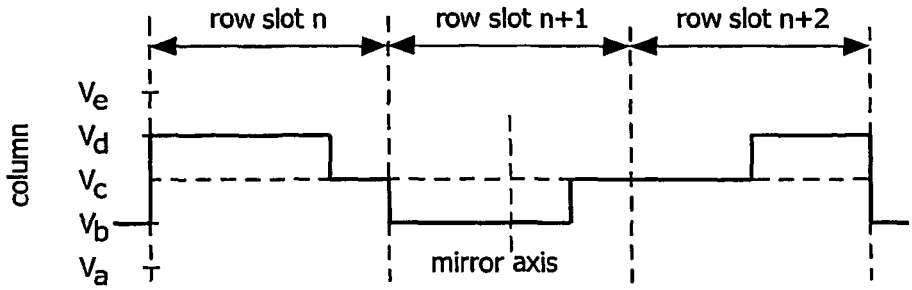
Figure 5B:
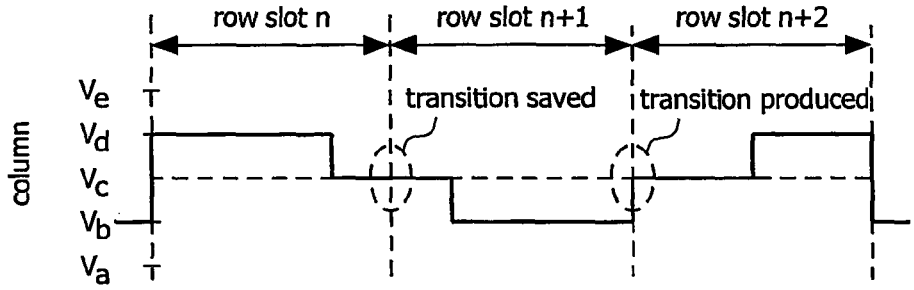
Figure 6A:
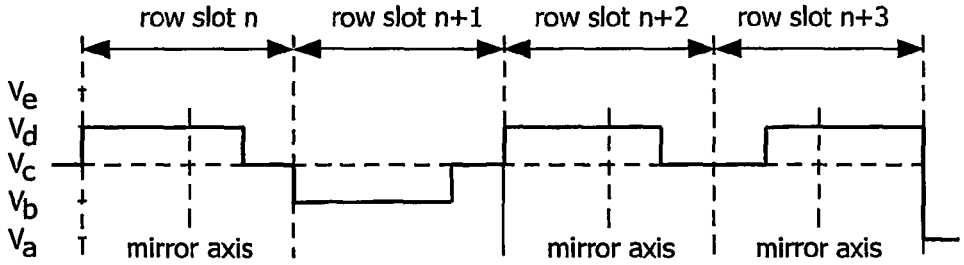
Figure 6B:
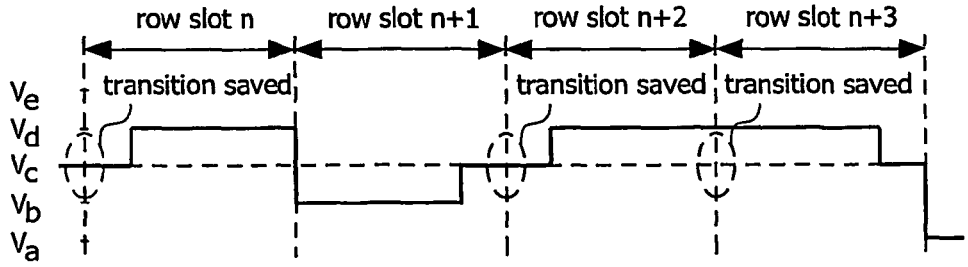
Figure 7A:
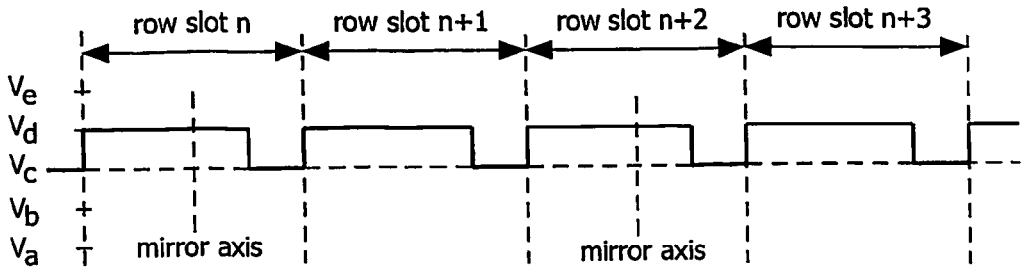
Figure 7B:
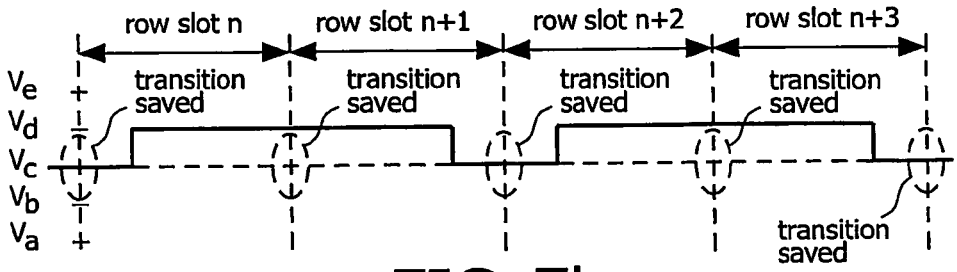
Figure 8A:
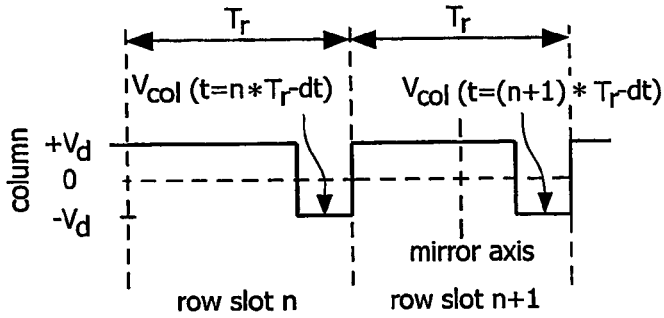

FIG. 4*a*, 4*b* illustrate the mirroring of the column voltage waveforms over two row slots for MRA with p=4 and PWM with $n_{pwm}$=4;

FIG. 5*a*, 5*b* illustrate the mirroring of the column voltage waveforms over three row slots for MRA with p=4 and PWM with $n_{pwm}$=4;

FIG. 6*a*, 6*b* illustrate the mirroring of the column voltage waveforms over four row slots for MRA with p=4 and PWM with $n_{pwm}$=4;

FIG. 7*a*, 7*b* illustrate the mirroring of the column voltage waveforms for MRA with p=4 and PWM with $n_{pwm}$=4 over four row slots thereby reducing the number of transition by 50%;

FIG. 8*a* shows the mirroring criterion in the Alt & Pleshko case with one row selection time subdivided into four sub selection time slots (PWM with $n_{pwm}$=4) when the grey scale table from Table 1 is used.

Figure 8B:
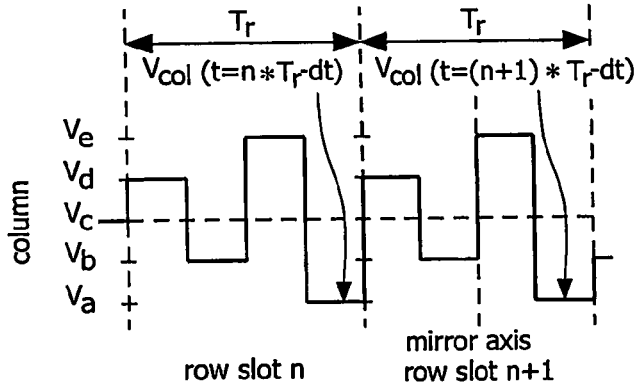
Figure 9:
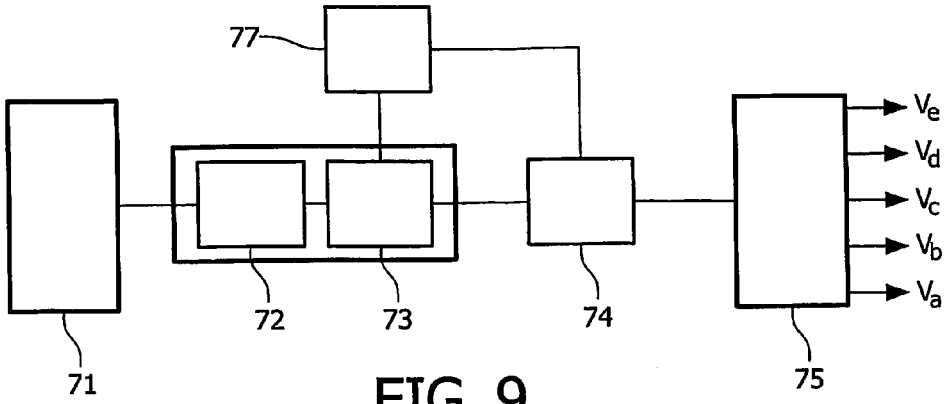

FIG. 8*b* shows the mirroring criterion in the MRA with p=4 case with one row selection time slot subdivided into four sub selection time slots (PWM with $n_{pwm}$=4);

FIG. 9 shows a block diagram for column voltage level generation

FIG. 10*a*, 10*b*, 10*c*, 10*d*, 10*e*, 10*f*, 10*g*, 10*h*, 10*i* are illustrating the mirroring within a window of subsequent row sub slot periods for MRA with p=4 and PWM with $n_{pwm}$=7.

Figure 1:
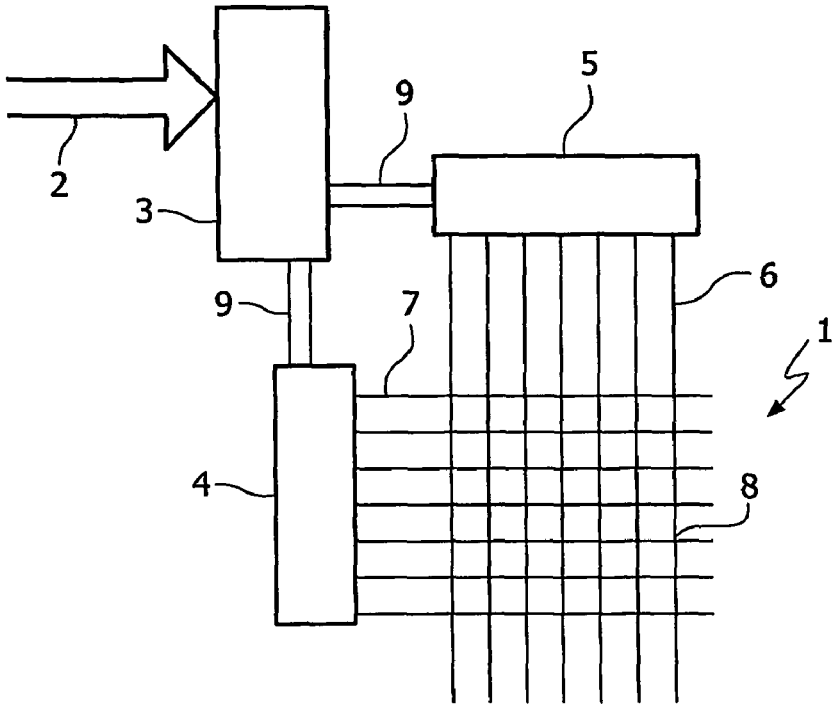
FIG. 1 shows an electric equivalent circuit diagram of a part of a display device according the present invention.

FIG. 1 shows an electric circuit diagram of a part of a display device 1 to which the invention is applicable. It comprises a matrix of pixels 8 defined by the areas of crossings of row or selection electrodes 7 and column or data electrodes 6. The row electrodes 7, in the Alt & Pleshko driving mode, are consecutively selected by means of a row driver 4, while the column electrodes 6 are provided with data via a data register 5. To this end, incoming data 2 are first processed, if necessary, in a processor 3. Mutual synchronization between the row driver 4 and the data register 5 takes place via drive lines 9. In the multiple row addressing mode (MRA) groups of p rows are selected simultaneously.

Figure 2:
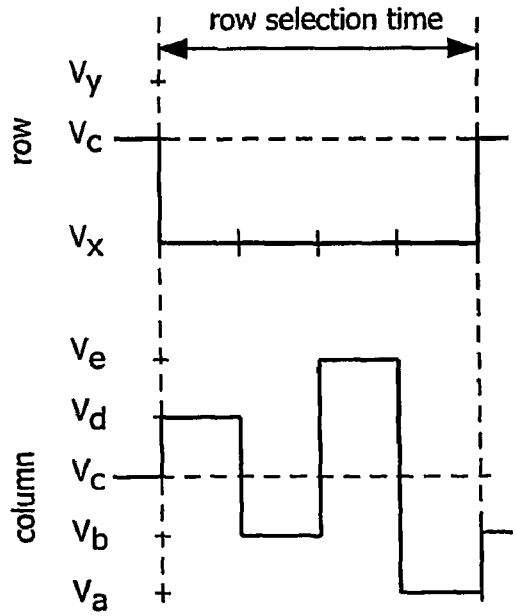
FIG. 2 shows possible column voltage levels during one row selection time for p=4 and PWM with $n_{pwm}$=4.

FIG. 2 shows the row selection voltage $V_x$, $V_y$ for a row selection time, which is supplied to the row electrode 7, depending on the orthogonal function $F_i(t)$ to be used. During that row selection time five different column voltages $V_a$, $V_b$, $V_c$, $V_d$, $V_e$ could be supplied to the respective column electrodes 6, whereas the number of column voltage levels depends on the number of concurrently driven rows p. In the example shown in FIG. 2 the number of concurrently driven rows p is 4, therefore five different voltage levels are used to drive the pixels in the selected rows. Further it is shown that the row selection time is divided into $n_{pwm}$=4 sub selection time slots.

Figure 3:
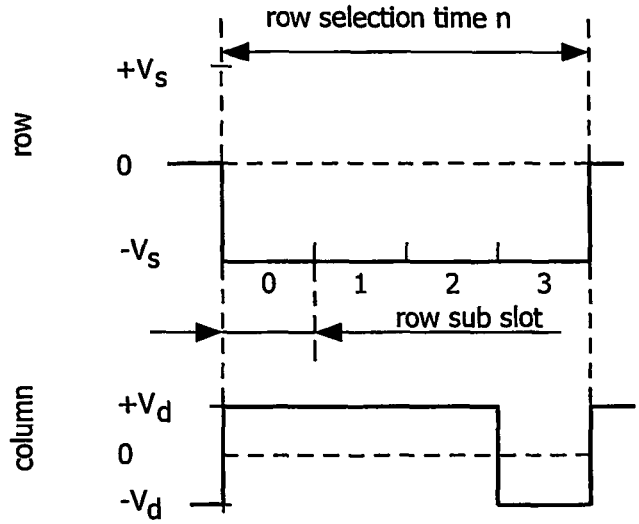
FIG. 3 shows an alternative possible column waveform when combining Alt & Pleshko driving with PWM with $n_{pwm}$=4 using the grey scale table from Table 1.

FIG. 3 shows a possible column voltage level during a row selection time for Alt & Pleshko driving with PWM $n_{pwm}$=4 provided that the grey scale table from Table 1 is used. The Alt & Pleshko driving method is a row-by-row respectively row-at-a-time driving technique that is the intuitive way of driving a passive matrix LCD. The row selection voltage is either −Vs or +Vs depending on the current state of the inversion. The corresponding column voltages are +/−Vd and −/+Vd respectively.

Referring to FIGS. 4*a* and 4*b*, FIG. 4*a* illustrates a possible column voltage waveform over two subsequent row selection time slots n, n+1 for MRA with p=4 and PWM with $n_{pwm}$=4 without using a mirroring. There are five transitions in the column voltage waveform visible, two belonging to the row selection time slot n, two belonging to the row selection time slot n+1 and one belonging to the not entirely depicted row selection time slot n+2. By using the inventive mirroring the column voltage waveform in the row selection time slot n+1 is mirrored on the mirror axis in the middle of the row selection time slot n+1. As a matter of fact it may happen that by mirroring the waveform in row slot n+1 one transition at the border between row slot n and row slot n+1 can be saved but on the other hand a new transition will be introduced at the border between row slot n+1 and row slot n+2. After the mirroring the waveform shows only four transitions, two belonging to the row selection time slot n, one belonging to the row selection time slot n+1 and one belonging to the not entirely depicted row selection time slot n+2. Referring now to the FIGS. 5*a*, 5*b*, there are three subsequent row slots n, n+1, n+2. FIG. 5*a* shows the column waveform during the three subsequent row selection times for MRA with p=4 and PWM with $n_{pwm}$=4 without using the inventive mirroring. The depicted waveform shows 6 transitions. FIG. 5*b* represents the column voltage waveform after the waveform in row slot n+1 has been mirrored. By doing this the transition at the border between row slot n and row slot n+1 is saved, but at the border between row slot n+1 and row slot n+2 a new transition is produced. Hence in this case no transition is saved. However, it is a matter of fact that the number of produced transitions will never be more than the saved number of transitions. This is due to the fact, that the mirroring is performed adaptively and not on a regular pattern such as e.g. fix on every second row selection time.

In the following FIGS. 6*a*, 6*b* the mirroring is performed adaptively. Therefore never more transitions will be produced than will be saved. In FIG. 6*a* four subsequent row slots n, n+1, n+2, n+3 are illustrated for MRA with p=4 and PWM with $n_{pwm}$=4. In FIG. 6*a* the column voltage waveform is not mirrored. It shows 8 transitions. It can be seen, that only for the row slots n, n+2, and n+3 a mirroring will be performed on the respective mirror axis. The resulting column voltage waveform after mirroring within the subsequent row slots n, n+1, n+2 and n+3 is represented in FIG. 6*b*. The waveform after mirroring shows only 6 transitions. By doing this adaptive mirroring consequently along the whole column voltage which is provided to a certain column, a large number of transitions can be saved, resulting in reduced power consumption.

The effectiveness of mirroring heavily depends on the picture to be displayed. The ideal picture of course consists of only one grey scale per column. In this case up to 50% of the transitions can be saved. An example for such a column voltage waveform without mirroring and with mirroring is illustrated in the FIGS. 7*a*, 7*b* for MRA with p=4 and PWM with $n_{pwm}$=4. By mirroring the column voltage waveform for that example shown in FIGS. 7*a*, 7*b* a total of 4 transitions can be saved over the four depicted row selection time slots, one per row selection time. Therewith, the number of transitions can be reduced by 50%. Is has to be noted that a transition at the end of a row selection time—if there is any—is always counted to the following row selection time.

FIGS. 8*a*, 8*b* illustrate the mirroring criterion, wherein FIG. 8*a* concerns the mirroring criterion in case of Alt & Pleshko driving with $n_{pwm}$=4. However, the same mirroring criterion is also valid for other grey scale tables and values of $n_{pwm}$. FIG. 8*b* concerns the mirroring criterion in case of MRA driving with p=4 and $n_{pwm}$=4. It has to be noted that these mirroring criterions are also valid for other values of p and $n_{pwm}$. The mirroring is performed adaptively, wherein the criterion for determining if the mirroring is performed or not for the respective row selection time is represented by the equitation Eq. (1), wherein $$V_{col}(t=nT_r-dt)=V_{col}(t=(n+1)T_r-dt) \text{ must be true} \quad (1)$$

for n=1, 2, 3 for the n subsequent row selection times, wherein $T_r$ represents the row selection time and dt one incremental time step. This means that the column voltage $V_{col}$ at the end of the current row selection time (t=n $T_r$–dt) must be the same as the column voltage $V_{col}$ at the end of the following row selection time (t=(n+1) $T_r$–dt).

FIG. 9 shows a block diagram for a circuitry for generating the column voltages $G_j(t)$, which are provided to the column electrodes 6. The Block 71 shows a part of memory RAM. This RAM Slice 71 stores i.e. the pixel data for one column of the display. The pixel data for that column is supplied to the grey scale control block 72. In the grey scale control block 72 a grey scale table is stored defining the coding of a grey scale to be displayed. The information of the grey scale to be displayed for a certain pixel is provided from the RAM slice 71. With the respective grey scale coding the column voltage $G_j(t)$ will be calculated within the column voltage $G_j(t)$ generator. Depending on the picture to be displayed the column voltage $G_j(t)$ has to be calculated $n_{pwm}$ times per row selection time. Its inputs are the pixel state $a_{i,j}$ from the GS-Control block 72 and the orthogonal function $F_i$, which are provided from an external source, which is not shown. The resulting column voltage waveform for the respective row selection time is provided to the mirror-control block 77 and to the register block 74 that registers the Gj(t)-function with the beginning of the next row selection time. IN the mirror-control block 77 the mirroring criteria of Eq. 1 is checked for each column voltage waveform for each row selection time. If the criteria is true the column voltage waveform, which is provided to the decoder 75 is mirrored. If the criterion is not true, no mirroring is performed for the subsequent row selection time. The decoder 75 decodes the coded column voltage level and activates the enable signal that corresponds to the column voltage level for driving the respective column. In the following the equitation for calculating the column voltage $G_j(t)$ will be given.

$$G_j(t) = \frac{1}{\sqrt{N}}\{a_{0,j} * F_0(t) + a_{1,j} * F_1(t) + a_{2,j} * F_2(t) + a_{3,j} * F_3(t)\} \quad (2)$$

whereas Eq. (2) represents the column driving voltage ($G_j(t)$-function) for MRA with p=4 for the column with index j for the duration a certain group of p rows is selected and under the assumption that the row index i is given as the row number modulo 4. Note: $a_{ij}$: pixel state of the pixel given by $row_i$ and $column_j$ (pixel in its ON state: $a_{ij}$=−1 dec (chosen to be represented by 0 digital), pixel in its OFF state: $a_{ij}$=+1 dec (chosen to be represented by 1 digital)).

$F_i(t)$: orthogonal function applied to $row_i$ (possible normalized values in case of the walking −1 set of orthogonal functions are: −1 dec (chosen to be represented by 0 digital), +1 dec (chosen to be represented by 1 digital).

Gj(t): column function to be applied to $column_j$ for the duration the respective group of p rows is selected.

N: number of rows of the display.

Below a grey scale table is shown illustrating the coding of five different grey scales by using a PWM with $n_{pwm}$=4. This means to display a pixel with e.g. grey scale 3, the pixel has to be driven during the first three row sub slots to an on state and in the last row sub slot to an off state respectively.

TABLE 1

| | Sub slot | | | |
|---|---|---|---|---|
| Grey scale | 0 | 1 | 2 | 3 |
| 0 | off | off | off | off |
| 1 | on | off | off | off |
| 2 | on | on | off | off |

TABLE 1-continued

| | Sub slot | | | |
|---|---|---|---|---|
| Grey scale | 0 | 1 | 2 | 3 |
| 3 | on | on | on | off |
| 4 | on | on | on | on |

Figure 10A:
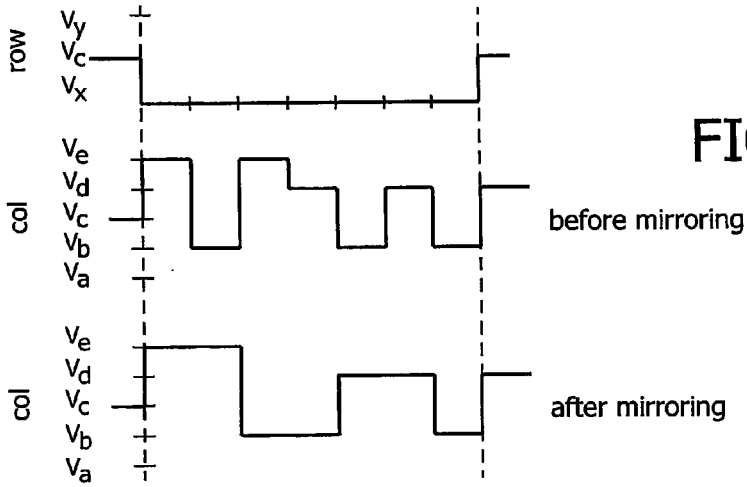

In the following a further embodiment of the inventive display device will be explained in more detail. It is also possible to mirror the column voltage waveform not only for a entire row selection time. It is also possible to mirror the column voltage waveform within a window of three or more subsequent row sub slots. In the case of a window of three row sub slots, whenever the voltage level of the third row sub slot is the same as the one in the first row sub slot, the second and the third row sub slot will be exchange—hence mirrored on the mirror axis between the second and third row sub slot. This however works only as long as the second and third row sub slots within the windows belong to the same row selection time. FIGS. 10*a*-10*f* illustrate the process of mirroring within a window as described above. In that embodiment the number of row sub slots $n_{pwm}$=7 within a row selection time. Therein the FIG. 10*a* shows at the top the row selection signal $F_i$. In the middle FIG. 10*a* shows the column voltage waveform without mirroring. At the bottom FIG. 10*a* shows the column voltage waveform after the mirroring is performed. Before mirroring there are 7 transitions belonging to the entirely depicted row selection time. After mirroring there are only 4 transitions belonging to the entirely depicted row selection time.

Figure 10B:
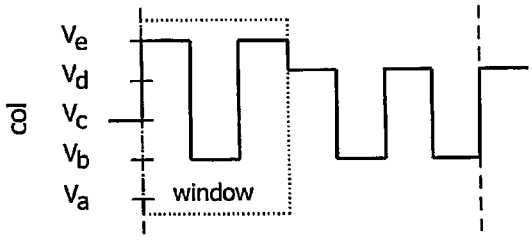
Figure 10C:
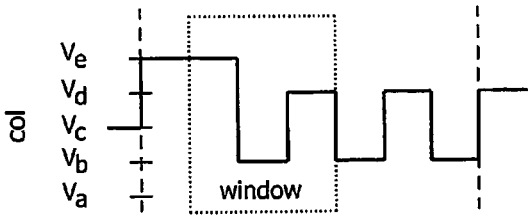
Figures 10D, 10E, 10F, 10G, 10H, 10I:
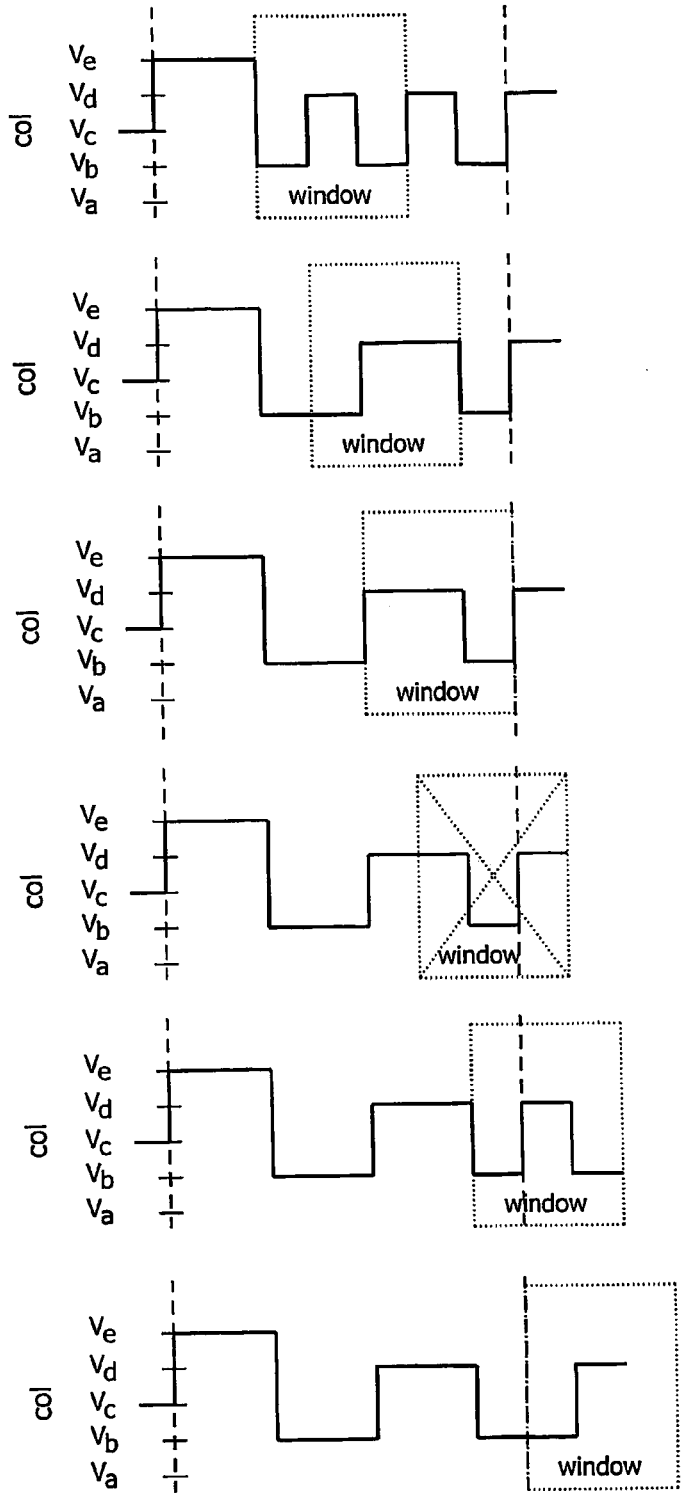

FIG. 10*b* shows the column voltage waveform before the first mirroring step is performed. The window includes the row sub slots 1-3. Then the mirroring is performed resulting in a column voltage waveform shown in FIG. 10*c*. Therein the voltage levels of the second and the third row sub slot are exchanged. Then the second mirroring step is performed, whereas the window includes the row sub slots 2-4. The column voltage level of the first row sub slot is not the same as the column voltage level of the third row sub slot within that window, therefore no mirroring is performed. Going to the third mirroring step shown in FIG. 10*d*, the windows includes the row sub slots 3-5. The column voltage level of the first row sub slot is the same as the column voltage level of the third row sub slot within that window of FIG. 10*d*, therefore the second and the third row sub slot are exchanged, resulting in the column voltage waveform shown in FIG. 10*e*. Then the fourth mirroring step is shown in FIG. 10*e*, wherein the window includes the row sub slots 4-6. The column voltage level of the first and the third row sub slot are not the same, so no mirroring is performed. Then the fifth mirroring step is shown in FIG. 10*f*, wherein the window includes the row sub slots 5-7. The column voltage level of the first and the third row sub slot are not the same, so no mirroring is performed. In FIG. 10*g* the windows is shift to the next row sub slots 6-8 respectively 6-1, however the sub slot 8 does not belong to the current row selection time, so no window mirroring is allowed. This due to the fact that otherwise the first row sub slot of the following row selection time would be exchanged with the last row sub slot of the current row selection time—and this would lead to a wrong grey scale. In FIG. 10*h* the window is shifted to the next row sub slots 7-9 respectively 7-2. The column voltage level of the first row sub slot is the same as the column voltage level of the last row sub slot within that window of FIG. 10*h*. Since the row sub slots to be exchanged in this window—row sub slot 8 and 9 respectively 1 and 2—belong again to the same row selection time, window mirroring is allowed again. FIG. 10*i* finally depicts the conditions after the seventh mirroring step of the current row selection time and before the first mirroring step of the following row selection time. In the end, the resulting column voltage waveform is that shown in FIG. 10*a* below.

In the following an example will be given for a window having four row sub slots. When the column voltage level in first row sub slot is identical with the column voltage level in the fourth row sub slot then mirroring is performed. Mirroring means to mirror the waveform given by the second, third and fourth row sub slot on a mirror axis in the middle of the third row sub slot. The order of the row sub slots before mirroring is 1 2 3 4, wherein the order of the row sub slots after mirroring will be 1 4 3 2.

In case of a window having five row sub slot window—the mirroring is performed, when the column voltage level in the first row sub slot is identical with the column voltage level in the fifth row sub slot. Mirroring means to mirror the waveform given by the second, third, fourth and fifth row sub slots on a mirror axis between the third and the fourth row sub slot. So the order of the row sub slots before mirroring is 1 2 3 4 5, wherein after mirroring: 1 5 4 3 2.

It has to be noted, that in both cases no mirroring is allowed when the window crosses the border to the next row selection time AND not all of the row sub slots to be mirrored are in the same row selection time.

The invention claimed is:

1. Display device comprising:

a liquid crystal material between a first substrate provided with row electrodes and a second substrate provided with column electrodes, row driving circuitry for driving selected row electrodes during a plurality of row selection times wherein, for each row selection time, at least one row electrode is selected, column driving circuitry for driving the column electrodes according to a column waveform that includes at least two different voltage levels and that is in conformity with a grayscale for the at least one row electrode that is selected and an image to be displayed, and processor circuitry for assessing a number of voltage transitions saved by mirroring of a particular column waveform for a row selection time, for assessing a number of voltage transitions produced by mirroring of the particular column waveform and for mirroring the particular column voltage waveform in response to the number of transitions saved exceeding the number of voltage transitions produced.

2. Display device as claimed in claim 1, wherein the mirroring is performed if the column voltage at the end of the current row selection time is the same as the column voltage at the end of the following row selection time.

3. Display device as claimed in claim 1, wherein groups of p rows are driven simultaneously and the row electrodes supply groups of p rows with mutually orthogonal selection signals for driving pixels, in which pixels are defined by overlapping parts of the row and column electrodes, wherein the column voltage is calculated depending on the grey scales to be displayed by the p concurrently driven pixels in a certain column and depending on the used mutually orthogonal selection signals for the respective group of p rows.

4. Display device as claimed in claim 1, wherein the row selection time is subdivided into $n_{pwm}$ sub slots and wherein processor circuitry is further for assessing, for each sub slot voltage transitions produced by mirroring a portion of the particular column waveform corresponding to the sub slot, assessing, for each sub slot voltage transition produced by mirroring the portion of the particular column waveform corresponding to the sub slot, and determining whether or not to mirror, for each sub slot, the portion of the particular column waveform in response to the number of transitions saved exceeding the number of voltage transitions produced.

5. Display device as claimed in claim 1, wherein the mirror axis is defined in the middle of a row selection time.

6. Display device as claimed in claim 1, wherein the mirror axis is defined adaptively.

7. Display device as claimed in claim 2, wherein the row selection time is subdivided into $n_{pwm}$ sub slots and the column voltage signal can have p+1 different voltage levels during a row selection time.

8. Display device as claimed in claim 1, wherein the following column voltage level for the subsequent row selection time is calculated during the current row selection time.

9. Circuit arrangement for driving a display device having row electrodes and column electrodes, the circuit arrangement comprising:

driving means for driving the column electrodes in conformity with an image to be displayed on the display, driving means for driving the row electrodes, at least one row electrode being selected during a row selection time and column voltages are supplied to the column electrodes, and processing circuitry for providing the column voltage waveform dependent on a grey scale to be displayed by a driven pixel in a certain column and dependent on a used selection signal supplied to the selected row, the column voltage including at least two different column voltage levels during the row selection time, and determining how many transitions will be produced and saved by mirroring the column voltage waveform for a following row selection time on a mirror axis, the determination based upon a function of the column voltage at the end of the current row selection time, the column voltage at the beginning of the following row selection time, the column voltage at the end of the following row selection time and the column voltage at the beginning of a row selection time after the following row selection time.

10. Method for driving a display device having row electrodes and column electrodes, the method comprising:

during a row selection time, selecting at least one row and supplying column voltages to the column electrodes, wherein the column voltage waveform depends on a grey scale to be displayed by a driven pixel in a certain column and depends on a used selection signal supplied to the selected row, the column voltage having at least two different column voltage levels during the row selection time, and mirroring the column voltage waveform for a following row selection time on a mirror axis, the mirroring dependent on a comparison of the total number of transitions before mirroring and the total number of transitions after mirroring as determined from the column voltage at the end of the current row selection time and the column voltage at the end of the following row selection time.

11. A display device comprising:

a liquid crystal material between a first substrate provided with row electrodes and a second substrate provided with column electrodes;

a driver circuit arrangement, including a row driver circuit and a column driver circuit, configured to drive the row electrodes and to drive the column electrodes in conformity with an image to be displayed, by during an initial row selection time, selecting at least one row and applying column voltages to the column electrodes using a voltage waveform for each column that is based upon a grey scale to be displayed by a driven pixel in the column and upon a selection signal supplied to the selected row, the column voltage being switchable between at least two different column voltage levels during the row selection time, and during a following row selection time immediately after the initial selection time, selectively applying column voltages to each of the column electrodes using the voltage waveform applied to the column during the initial row selection time as mirrored on a mirror axis, based upon a determination of how many transitions will be produced and saved, the determination based upon the column voltage at the end of said row selection time and the column voltage at the end of the following row selection time.

12. The display device of claim 11, wherein the driver circuit arrangement is configured to selectively apply column voltages to the column electrodes during the following row selection time by applying a mirrored version of the voltage waveform applied to the column electrodes during the initial row selection time, in response to the column voltage at the end of the initial row selection time being the same voltage as the column voltage at the end of the following row selection time.

13. The display device of claim 11, wherein the driver circuit arrangement is configured to drive groups of p rows simultaneously, the row electrodes supply the groups of p rows with mutually orthogonal selection signals for driving pixels, in which pixels are defined by overlapping parts of the row and column electrodes, and the driver circuit arrangement calculates the column voltage based upon the grey scales to be displayed by the p concurrently driven pixels in a certain column, and the mutually orthogonal selection signals for the respective group of p rows.

14. The display device of claim 11, wherein the driver circuit arrangement selectively applies the mirrored voltage waveform based upon a characteristic of the picture to be displayed.

15. The display device of claim 11, wherein the driver circuit arrangement selectively applies the mirrored voltage waveform when the application of the mirrored voltage waveform eliminates a column voltage transition between the initial and following row selection times.

16. The display device of claim 11, wherein the driver circuit arrangement only applies the mirrored voltage waveform when the application of the mirrored voltage waveform eliminates a column voltage transition between the initial and following row selection times.

17. The display device of claim 11, wherein the driver circuit arrangement is configured, for time window having at least three row sub selection time slots, to selectively apply a mirrored voltage waveform in response to a voltage level of the third row sub selection time slot being the same as the voltage level as the first row sub selection time slot.

18. The display device of claim 11, wherein the driver circuit arrangement is configured, for time window having at least three row sub selection time slots, to selectively apply a mirrored voltage waveform in response to a voltage level of the third row sub selection time slot being the same as the voltage level as the first row sub selection time slot, by exchanging the voltage waveform in the second row sub selection time slot with the voltage in the third row sub selection time slot to mitigate voltage transitions between the time slots.

* * * * *